US009107278B2

(12) United States Patent
Jiang et al.

(10) Patent No.: US 9,107,278 B2
(45) Date of Patent: Aug. 11, 2015

(54) STACKER AND STATIC ELIMINATION DEVICE FOR THE SAME

(71) Applicant: Shenzhen China Star Optoelectronics Technology Co., Ltd., Shenzhen, Guangdong (CN)

(72) Inventors: Yunshao Jiang, Shenzhen (CN); Chunhao Wu, Shenzhen (CN); Kunhsien Lin, Shenzhen (CN); Yongqiang Wang, Shenzhen (CN); Zhiyou Shu, Shenzhen (CN); Zhenhua Guo, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 382 days.

(21) Appl. No.: 13/699,705

(22) PCT Filed: Nov. 5, 2012

(86) PCT No.: PCT/CN2012/084096
§ 371 (c)(1),
(2) Date: Nov. 23, 2012

(87) PCT Pub. No.: WO2014/067164
PCT Pub. Date: May 8, 2014

(65) Prior Publication Data

US 2014/0118878 A1 May 1, 2014

(30) Foreign Application Priority Data

Oct. 29, 2012 (CN) ..... 2012 1 0420257

(51) Int. Cl.
*H05F 3/00* (2006.01)
*H05F 3/04* (2006.01)
*H05F 3/06* (2006.01)

(52) U.S. Cl.
CPC ... *H05F 3/06* (2013.01); *H05F 3/04* (2013.01)

(58) Field of Classification Search
CPC ..... H05F 3/06
USPC ..... 361/213
See application file for complete search history.

(56) References Cited

U.S. PATENT DOCUMENTS

| | | | | |
|---|---|---|---|---|
| 4,188,530 | A * | 2/1980 | Miller | 250/324 |
| 7,940,509 | B2 * | 5/2011 | Orihara et al. | 361/231 |
| 8,576,535 | B2 * | 11/2013 | Sekoguchi | 361/230 |
| 2006/0187597 | A1 * | 8/2006 | Onezawa et al. | 361/56 |
| 2009/0116162 | A1 * | 5/2009 | Onezawa et al. | 361/213 |

* cited by examiner

*Primary Examiner* — Dharti Patel
(74) *Attorney, Agent, or Firm* — Andrew C. Cheng

(57) ABSTRACT

The present invention provides a static elimination device which is used for a stacker with a fan filter device. Characterize in that the static elimination device is provided at the end side of each shelf facing the fan filter device in the stacker. Said end side is opposite to the end side of the shelf which a cartridge moves in and out. Two ends of the static elimination device are free to rotate and connected to shelf holders at said end side. Under the action of the fan filter device blowing the airflow, the ions, which are used to eliminate the static, are blown from the static elimination device into the cartridge of the shelf and the surface of the glass substrate on the cartridge. The present invention further provides a stacker. The stacker and the static elimination device according to the present invention can effectively eliminate the static of the cartridge and the glass substrate surface in the same, which can decrease the equipment costs.

20 Claims, 5 Drawing Sheets

STACKER AND STATIC ELIMINATION DEVICE FOR THE SAME

This application claims priority to Chinese Patent Application Serial No. 201210420257.3, named as "stacker and static elimination device for the same", filed on Oct. 29, 2012, the specification of which is incorporated herein by reference.

BACKGROUND OF THE INVENTION

1. Field of the Invention

The present invention relates to a liquid crystal panel production technology, and in particular to a static elimination device and a stacker.

2. The Related Arts

In display panel, especially in the production factory of the organic light-emitting diode (OLED) panel, static is a critical influence factor in the production yield of the panel. Therefore, it is needed to control and eliminate the static effectively in every process of production lines.

Stackers are important equipments within the automated panel production processes. Controlling and eliminating static effectively plays an important role in improving product yield. At present, various types of stackers don't have device for eliminating static.

Referring to FIG. 7, it is a schematic view illustrating the structure of a static elimination device provided on the shelf holder of the stacker according to the known technology. Wherein, the static elimination device 91 has two parts, which are respectively provided on the upper and lower shelf holders 92 at the two side of the shelf 9 and used to eliminate the static. In the structure of the stacker, multiple fan filter devices (a cleaning equipment, which can blow air flow for cleaning) provided in the stacker are not considered, and the inventors have discovered the following shortcomings:

1. The direction of the air flow blown from the fan filter device is vertical and even opposite to that blown from the static elimination device, which interrupts the release of ion air, and the static on the surface of the glass substrate cannot be eliminated effectively.
2. Too many static elimination device provided on each shelf is not beneficial to control costs; and the efficiency of eliminating static is too low to decrease the product yield.

SUMMARY OF THE INVENTION

To solve the technical issue in the known technology, the present invention provides a stacker and a static elimination device, which can effectively eliminate the static of the cartridge and the glass substrate surface in the same, which can decrease the equipment costs.

To solve the technical issue mentioned above, the present invention provides: a static elimination device, which is used for a stacker with a fan filter device, wherein the static elimination device is provided at the end side of each shelf facing the fan filter device in the stacker, said end side is opposite to the end side of the shelf which a cartridge moves in and out, two ends of the static elimination device are free to rotate and connected to shelf holders at said end side; under the action of the fan filter device blowing the airflow, the ions blown from the static elimination device into the cartridge of the shelf and the surface of the glass substrate on the cartridge, which is used to eliminate the static on the glass substrate; the static elimination device comprises a controller which is used to control the static elimination device to rotate in any angle.

Wherein, the two ends of the static elimination device are free to rotate and connected to the upper and lower shelf holders at said end side.

Wherein, the rotation angle of the static elimination device is between 0° and 180°.

Wherein, the static elimination device comprises: a box which can generate charged ions, and the surface of the box provided with a long strip slit; wherein a rotary shaft is provided through and connected with the rectangular box; both ends of the rotary shaft are fixed on upper and lower shelf holders respectively; a standpipe provided inside the rectangular box and used for air intake, the vertical direction of the standpipe provided with a horizontal transverse plate, the horizontal transverse plate vertically provided with an ion generator used to generate and release the charged ions; a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

Wherein, the static elimination device further comprises a pulley connected with the rotary shaft, and the pulley is provided with a driver to drive the pulley and then rotates the rotary shaft.

Wherein, the driver is a servo motor.

Wherein, the static elimination device further comprises power wires connected with the standpipe and the horizontal transverse plate, which supplies power to the blowing device and the ion generator respectively.

Wherein, the blowing device is an air blower, and the ion generator is a discharging needle.

Wherein, the standpipe is parallel with the rotary shaft, the horizontal transverse plate provided on the vertical direction of the standpipe is multilayer, and each layer of the horizontal transverse plate is provided with the discharging needle.

To solve the technical issue mentioned above, the present invention further provides: a static elimination device, which is used for a stacker with a fan filter device, wherein the static elimination device is provided at the end side of each shelf facing the fan filter device in the stacker, said end side is opposite to the end side of the shelf which a cartridge moves in and out, two ends of the static elimination device are free to rotate and connected to shelf holders at said end side; under the action of the fan filter device blowing the airflow, the ions blown from the static elimination device into the cartridge of the shelf and the surface of the glass substrate on the cartridge, which is used to eliminate the static on the glass substrate.

Wherein, the rotation angle of the static elimination device is between 0° and 180°.

Wherein, the static elimination device comprises a controller which is used to control the static elimination device to rotate in any angle.

Wherein, the two ends of the static elimination device are free to rotate and connected to the upper and lower shelf holders at said end side.

To solve the technical issue mentioned above, the present invention further provides: a stacker, comprising: multiple shelves, a crane, a fork, and a fan filter device; wherein at least one fan filter device is provided on the end side of the multiple shelves and facing the same, said end side of each said shelf is opposite to the end side of said shelf which a cartridge moves in and out, a static elimination device, which is free to rotate, is provided on said end side of each said shelf holder; under the action of the fan filter device blowing the airflow, the ions blown from the static elimination device into the cartridge of the shelf and the surface of the glass substrate on the cartridge, which is used to eliminate the static on the glass substrate.

Wherein, the rotation angle of the static elimination device is between 0° and 180°.

Wherein, the fan filter device further comprises other two groups: one is provided on the ceiling of the stacker, which can blow air flow from top to bottom; the other is provided and has a certain distance to the end side of the shelf which a cartridge moves in and out, which is used to blow air flow to the end side of the shelf which a cartridge moves in and out.

Wherein, the air flow blew from the fan filter device allows the static elimination device blowing directional ion air flow.

Wherein, the static elimination device comprises a controller which is used to control the static elimination device to rotate in any angle.

Wherein, the two ends of the static elimination device are free to rotate and connected to the upper and lower shelf holders at said end side.

The stacker and the static elimination device according to the present invention have the beneficial effects as follows: the ion air blown from the static elimination device can flow directionally accompanied with the air flow generated from the fan filter device, which may spray to every corner of the cartridge and the surface of the glass substrate and eliminate the static on the glass substrate effectively and improve the product yield. The static elimination device can rotate in the angle of 0°-180° and spray charged ions without blind spots and dead ends under the control of the controller, which can effectively eliminate the static of the cartridge and the glass substrate surface in the same, which can decrease the equipment costs.

DETAILED DESCRIPTION OF THE PREFERRED EMBODIMENTS

The detailed descriptions accompanying drawings and the preferred embodiment of the present invention are as follows.

Figure 1:
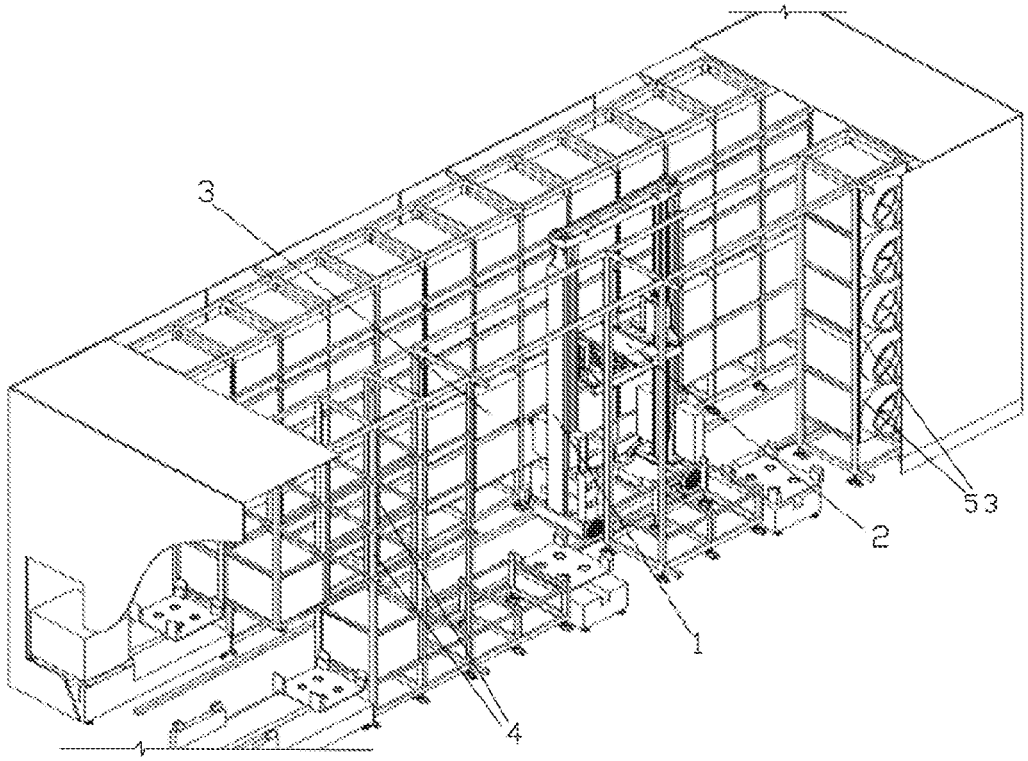
FIG. 1 is a schematic view illustrating the structure of a stacker according to the present invention.

FIG. 1 is a schematic view illustrating the structure of a stacker according to the present invention. The stacker according to the present invention comprises a crane 1, a fork 2, multiple shelves 4 used to store cartridges 3, and a fan filter device. Wherein, the crane 1 transports the large-size glass substrate within the cartridge 3 from outside to the shelves 4 by the fork 2 and then into the pipeline transmission.

Figure 2:
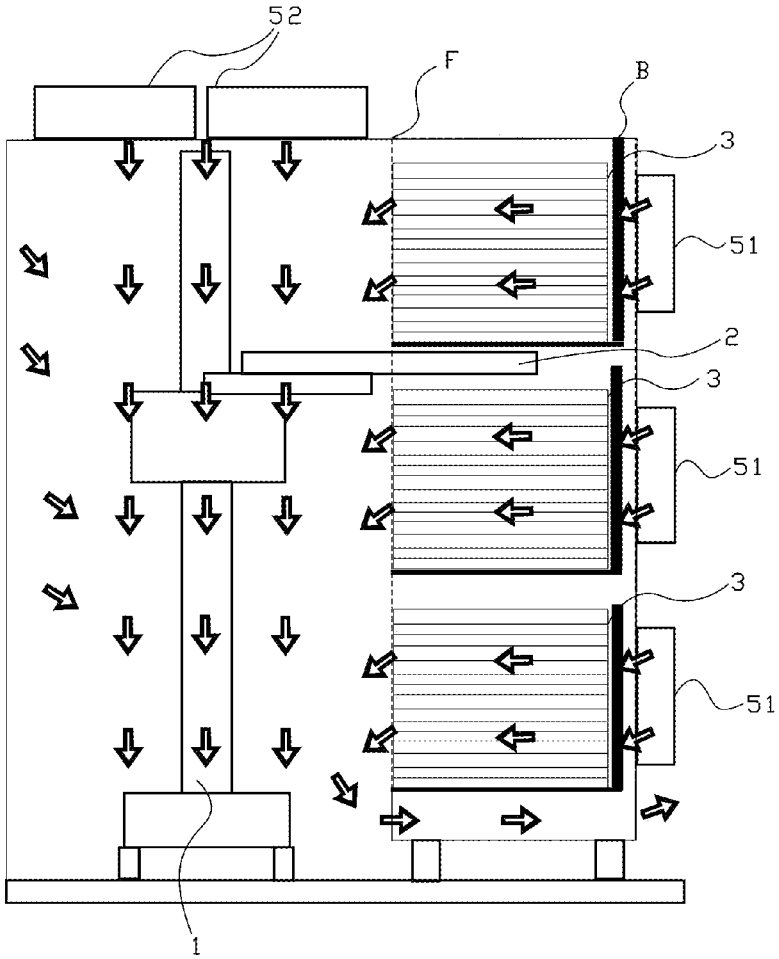
FIG. 2 is a schematic view illustrating the directional air flow while a fan filter device of a stacker according to the present invention is working.

Referring to FIG. 2, it is a schematic view illustrating the directional air flow while the fan filter device of the stacker according to the present invention is working. In this embodiment, three fan filter devices are provided, which are a first fan filter device 51, a second fan filter device 52, and a third fan filter device 53, respectively. The first fan filter device 51 is provided at the end side B facing the multiple shelves. The detail description of the structure is as follows.

Figure 3:
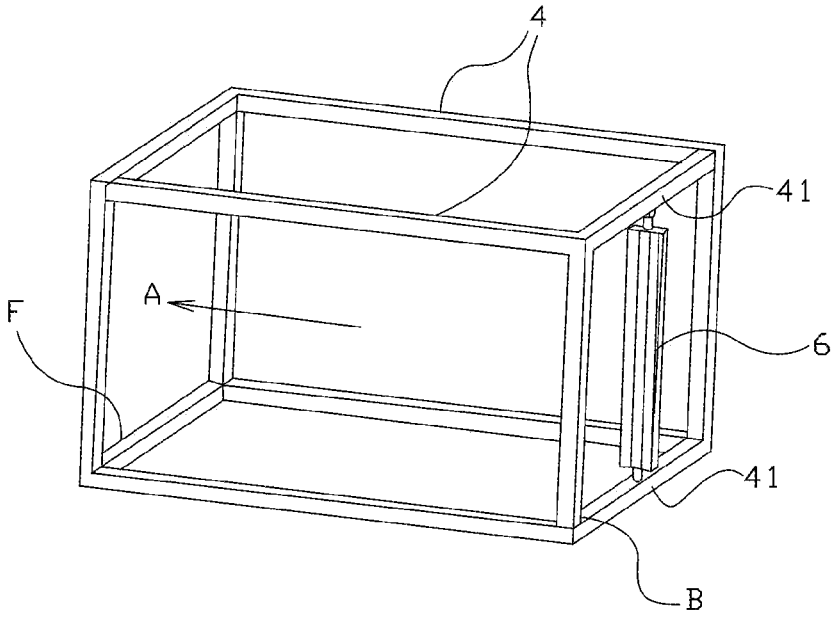
FIG. 3 is a schematic view illustrating the structure of a static elimination device provided on a shelf holder of a stacker according to the present invention.

Referring to FIG. 3, it is a schematic view illustrating the structure of a static elimination device provided on a shelf holder of a stacker according to the present invention. The shelf 4 is a cubic-shaped frame structure formed by multiple shelf holders 41 bonding to each other. The frame can be stacked in a certain order and form the storage wall as shown in FIG. 1.

Each shelf 4 can store the cuboidal cartridge 3 which size is roughly the same. The crane 1 can move the cartridge 3 at the shelf 4 by the fork 2. The cartridge 3 is moved in and out along the A direction as shown in FIG. 2.

The way of the cartridge 3 moving in and out the multiple shelves is provided at the F end side, as shown in FIG. 1, of the storage wall. The first fan filter device 51 is provided at B end side facing the multiple shelves. The B end side is opposite to the F end side which the cartridge 3 moves in and out the shelf 4. That is, the first fan filter device 51 is provided neighbor the B end side of each shelf.

In the present embodiment, the static elimination device 6 is provided at the middle of the upper and lower shelf holders 41 at the B end side of each shelf and perpendicular to the upper and lower shelf holders 41. The static elimination device 6 can rotate by taking its two ends as shaft. The rotating structure is described as follows.

When working, the crane 1 of the stacker moves the cartridge 3 in or out the shelf 4 using the robot of the fork 2. The static elimination device 6 blows out the charged ions. Under the action of the first fan filter device 51 blowing the airflow, the ions are blown from the B end side to the F end side which the cartridge 3 moves in and out the shelf 4, which eliminates the static on the glass substrate in the cartridge effectively and improve the product yield.

One of the fan filter device, that is the second fan filter device 52, is provided at the ceiling 8 of the stacker. The second fan filter device 52 blows down the air flow from the ceiling 8, which is combined with the air flow blown from the first fan filter device 51 at the F end side and allows the static elimination device 6 blowing directional ion air flow.

In order to improve the directional ion air flow, the other fan filter device 53 is provided near the F end side which the cartridge 3 moves in and out the shelf 4, which is standing structure and blows air flow to the F end side. In this way, the air flows blown from three fan filter devices converge near the F end side and then dismiss from the bottom of the storage wall, which improves the ion air flow eliminating the static of the cartridge and the glass substrate inside the same.

The function of the static elimination device 6 provided at the B end side of each shelf 4 is as follows. The static elimination device 6 is provided at the front side of the first fan filter device 51 and by the air outlet of the first fan filter device 51. In that way, the ions blown from the static elimination device 6 can directionally flow along the air flow generated from the fan filter device, which may be sprayed to every corner of the cartridge 3 and the surface of the glass substrate and eliminate the static on the glass substrate effectively without dead space.

Figure 4:
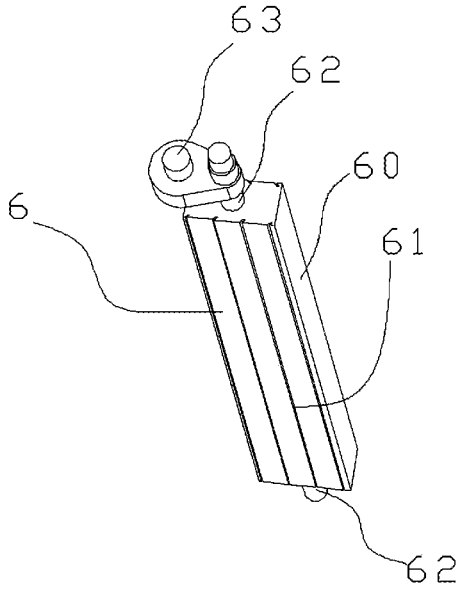
FIG. 4 is a schematic view illustrating the three-dimensional structure of the static elimination device according to the present invention.

Referring to FIG. 4, it is a schematic view illustrating the three-dimensional structure of the static elimination device according to the present invention. The static elimination device 6 comprises a rectangular box 60 which can produce charged ions. The surface of the rectangular box provided with a long strip slit 61. The charged ion generated from the box 60 can be blown out through the long strip slit 61.

A rotary shaft 62 is provided through and connected with the box 60, and both ends of the rotary shaft 62 are fixed on the upper and lower shelf holders 41 respectively. On the top surface of the box 60, a driver (not shown in FIG. 3) is connected with the rotary shaft 62 through a pulley 63, and then adjusts the rotation direction of the rotary shaft 62 through transmitting the belt.

When the rotary shaft 62 rotates, the box 60 can rotate corresponding to the shelf holder 41, which expands the reach of the charged ions to eliminate the static on the glass substrate in greater angle.

Figure 5:
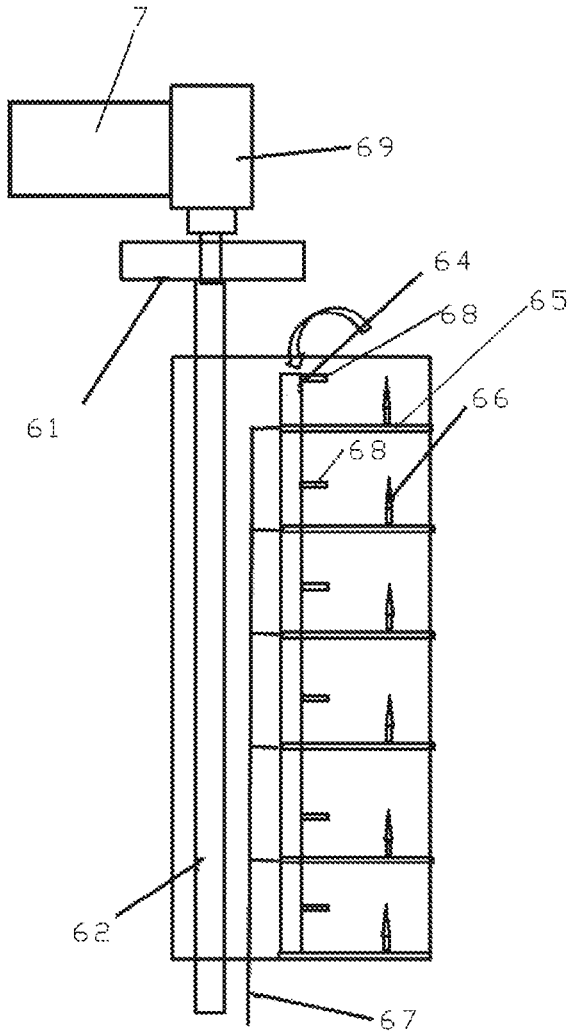
FIG. 5 is a schematic view illustrating the internal structure of the static elimination device according to the present invention.

Referring to FIG. 5, it is a schematic view illustrating the internal structure of the static elimination device according to the present invention. A standpipe 64 parallel with the rotary shaft 62 used for air intake is provided inside the rectangular box 60. The vertical direction of the standpipe 64 is provided with a horizontal transverse plate 65. The horizontal transverse plate 65 is vertically provided with an ion generator 66 used to generate the charged ions. In the present embodiment, the ion generator 66 is a discharging needle. A blowing device 68 is also provided on the standpipe 64 at the height corresponding to the ion generator 66, which blows the charged ions out the rectangular box 60 through the long strip slit 61. In the present embodiment, the blowing device 66 is an air blower. Power wires 67 are connected with the standpipe 64 and the horizontal transverse plate 65, which supplies power to the blowing device 66 and the discharging needle 68 respectively. The pulley 63 is connected with the rotary shaft 62. The pulley 63 is provided with a driver 69. In the present embodiment, the driver 69 is a servo motor.

Furthermore, the stacker comprises a controller 7 which is used to control the static elimination device to rotate in any angle. The controller is connected with the servo motor. The rotary shaft 62 can rotate in the angle between 0°-180° by controlling the servo motor.

Figure 6:
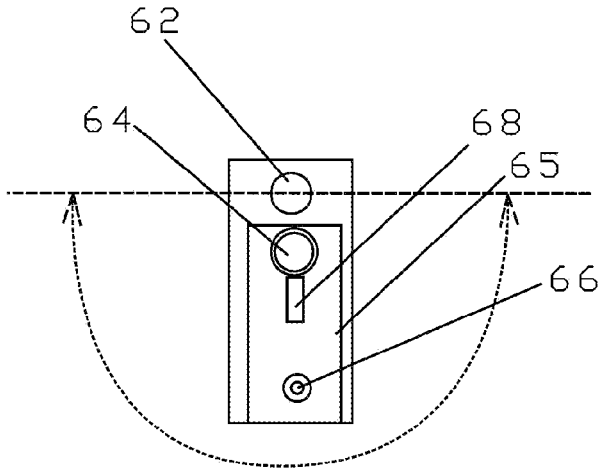
FIG. 6 is a top view illustrating the structure of the static elimination device according to the present invention.
Figure 7:
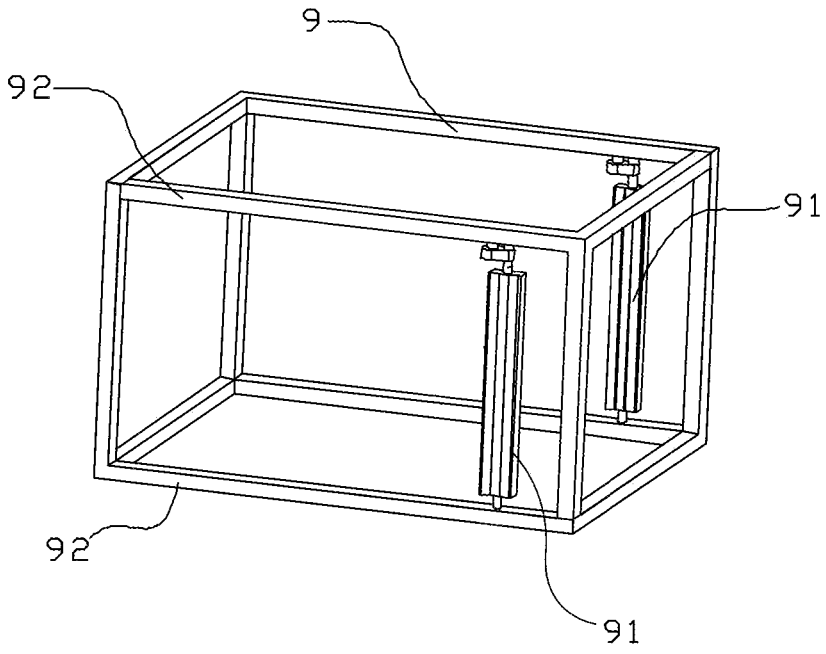
FIG. 7 is a schematic view illustrating the structure of a static elimination device provided on a shelf holder of a stacker according to the known technology.

The usage of the static elimination device according to the present invention is shown in FIG. 6. After the servo motor 69 receives the rotating message from the controller 7, it drives the pulley 63 to rotate and then adjust the rotation direction of the shaft 62 through transmitting the belt. Because the shaft 62 is fixed and connected with the rectangular box 60, the static elimination devices 6 will be driven to rotate in a certain angle, which is specifically 30°, 90°, 150° or 180°, while the cartridge 3 moves in and out.

At the same time, switch on the power lines 67, the compressed air is injected into the standpipe 64 and blew out the blowing device 68, which blows the charged ions generated from the discharging needle 66 into the cartridge through the long strip slit 61. The static elimination device 6 is provided at the front side of the first fan filter device 51 and by the air outlet of the first fan filter device 51. In that way, the ions blown from the static elimination device 6 can directionally flow along the air flow generated from the fan filter device, which may be sprayed to every corner of the cartridge 3 and the surface of the glass substrate.

In addition, because the cartridge 3 is multilayer structure, the vertical direction of the standpipe 64 can be further provided with a horizontal transverse plate 65. In this way, the charged ions generated from the discharging needle 66 on each layer of the horizontal transverse plate 65 can be blown to each layer of glass substrate inside the cartridge, which improves the efficiency of static elimination.

Because the static elimination device 6 is provided at the front side of the first fan filter device 51, the ion air can eliminate the static under the directional air flow, which can accordingly reduce the number of the installed static elimination device 6. That is, only one static elimination device 6 is needed to be provided on the shelf holder 41 at the B end side of each shelf, which has the same static elimination effect with that the static elimination devices 6 are provided on the upper and lower shelf holders 41 at two sides of each shelf. Therefore, the equipment costs can be reduced.

In the other embodiments of the static elimination device according to the present invention, the installed position of the rotary shaft 62 at two sides of the static elimination device 6 can be adjusted according to how to place the night crystal glass in the cartridge 3. For example, it can be installed on the left and right shelf holders 41 at the B end side of each shelf, which has the same effects.

Furthermore, according to the requirement of the directional flow path of the ion air, only said first fan filter device 51 is provided or the first fan filter device 51 and the second fan filter device 52 are provided, which can spray the ion air blown from the static elimination device 6 along the air flow generated from the fan filter device to every corner of the cartridge 3 and the surface of the glass substrate.

The stacker and the static elimination device according to the present invention have the beneficial effects as follows: the ion air blown from the static elimination device can flow directionally accompanied with the air flow generated from the fan filter device, which may spray to every corner of the cartridge and the surface of the glass substrate and eliminate the static on the glass substrate effectively and improve the product yield. The static elimination device can rotate in the angle of 0°-180° and spray charged ions without blind spots and dead ends under the control of the controller, which can effectively eliminate the static of the cartridge and the glass substrate surface in the same, which can decrease the equipment costs.

The preferred embodiments according to the present invention are mentioned above, which cannot be used to define the scope of the right of the present invention. Those modifications and variations are considered encompassed in the scope of protection defined by the claims of the present invention.

What is claimed is:

1. A static elimination device, which is used for a stacker with a fan filter device, wherein the static elimination device is provided at the end side of each shelf facing the fan filter device in the stacker, said end side is opposite to the end side of the shelf which a cartridge moves in and out, two ends of the static elimination device are free to rotate and connected to shelf holders at said end side;

under the action of the fan filter device blowing the airflow, the ions are blown from the static elimination device into the cartridge of the shelf and the surface of the glass substrate on the cartridge, which is used to eliminate the static on the glass substrate;

the static elimination device comprises a controller which is used to control the static elimination device to rotate in any angle.

2. The static elimination device as claimed in claim 1, wherein the two ends of the static elimination device are free to rotate and connected to the upper and lower shelf holders at said end side.

3. The static elimination device as claimed in claim 2, wherein the rotation angle of the static elimination device is between 0° and 180°.

4. The static elimination device as claimed in claim 1, wherein the static elimination device comprises:

a box which can generate charged ions, and the surface of the box provided with a long strip slit; wherein a rotary shaft is provided through and connected with the rectangular box; both ends of the rotary shaft are fixed on upper and lower shelf holders respectively;

a standpipe provided inside the rectangular box and used for air intake, the vertical direction of the standpipe provided with a horizontal transverse plate, the horizontal transverse plate vertically provided with an ion generator used to generate and release the charged ions;

a blowing device provided on the standpipe, the blowing device blowing the charged ions generated and released from the ion generator into and out of a cartridge of the shelf through the long strip slit which is provided on the surface of the rectangular box, to eliminate the static electricity of a glass substrate in the cartridge.

5. The static elimination device as claimed in claim 4, wherein the static elimination device further comprises a pulley connected with the rotary shaft, and the pulley is provided with a driver to drive the pulley and then rotates the rotary shaft.

6. The static elimination device as claimed in claim 5, wherein the driver is a servo motor.

7. The static elimination device as claimed in claim 5, wherein the static elimination device further comprises power wires connected with the standpipe and the horizontal transverse plate, which supplies power to the blowing device and the ion generator respectively.

8. The static elimination device as claimed in claim 7, wherein the blowing device is an air blower, and the ion generator is a discharging needle.

9. The static elimination device as claimed in claim 8, wherein the standpipe is parallel with the rotary shaft, the horizontal transverse plate provided on the vertical direction of the standpipe is multilayer, and each layer of the horizontal transverse plate is provided with the discharging needle.

10. A static elimination device, which is used for a stacker with a fan filter device, wherein the static elimination device is provided at the end side of each shelf facing the fan filter device in the stacker, said end side is opposite to the end side of the shelf which a cartridge moves in and out, two ends of the static elimination device are free to rotate and connected to shelf holders at said end side;

under the action of the fan filter device blowing the airflow, the ions are blown from the static elimination device into the cartridge of the shelf and the surface of the glass substrate on the cartridge, which is used to eliminate the static on the glass substrate.

11. The static elimination device as claimed in claim 10, wherein the rotation angle of the static elimination device is between 0° and 180°.

12. The static elimination device as claimed in claim 11, wherein the static elimination device comprises a controller which is used to control the static elimination device to rotate in any angle.

13. The static elimination device as claimed in claim 10, wherein the two ends of the static elimination device are free to rotate and connected to the upper and lower shelf holders at said end side.

14. A stacker, comprising: multiple shelves, a crane, a fork, and a fan filter device; wherein at least one fan filter device is provided on the end side of the multiple shelves and facing the same, said end side of each said shelf is opposite to the end side of said shelf which a cartridge moves in and out, a static elimination device, which is free to rotate, is provided on said end side of each said shelf holder;

under the action of the fan filter device blowing the airflow, the ions are blown from the static elimination device into the cartridge of the shelf and the surface of the glass substrate on the cartridge, which is used to eliminate the static on the glass substrate.

15. The stacker as claimed in claim 14, wherein the rotation angle of the static elimination device is between 0° and 180°.

16. The stacker as claimed in claim 14, wherein the fan filter device further comprises other two groups: one is provided on the ceiling of the stacker, which can blow air flow from top to bottom; the other is provided and has a certain distance to the end side of the shelf which a cartridge moves in and out, which is used to blow air flow to the end side of the shelf which a cartridge moves in and out.

17. The stacker as claimed in claim 14, wherein the air flow blew from the fan filter device allows the static elimination device blowing directional ion air flow.

18. The stacker as claimed in claim 17, wherein the rotation angle of the static elimination device is between 0° and 180°.

19. The stacker as claimed in claim 18, wherein the static elimination device comprises a controller which is used to control the static elimination device to rotate in any angle.

20. The stacker as claimed in claim 14, wherein the two ends of the static elimination device are free to rotate and connected to the upper and lower shelf holders at said end side.

* * * * *